US012031421B2

(12) United States Patent
Maxwell et al.

(10) Patent No.: US 12,031,421 B2
(45) Date of Patent: Jul. 9, 2024

(54) MODULAR SOLUTION MINING SYSTEM AND METHODS

(71) Applicants: Max Maxwell, New Orleans, LA (US); Major Patterson, Columbia, MS (US); Roger Smith, Reno, NV (US)

(72) Inventors: Max Maxwell, New Orleans, LA (US); Major Patterson, Columbia, MS (US); Roger Smith, Reno, NV (US)

( * ) Notice: Subject to any disclaimer, the term of this patent is extended or adjusted under 35 U.S.C. 154(b) by 65 days.

(21) Appl. No.: 17/687,089

(22) Filed: Mar. 4, 2022

(65) Prior Publication Data

US 2022/0282607 A1 Sep. 8, 2022

Related U.S. Application Data

(60) Provisional application No. 63/157,315, filed on Mar. 5, 2021.

(51) Int. Cl.

| | |
|---|---|
| ***E21B 43/28*** | (2006.01) |
| ***E21B 43/14*** | (2006.01) |
| ***E21B 43/30*** | (2006.01) |

(52) U.S. Cl.

CPC ..... *E21B 43/281* (2013.01); *E21B 43/14* (2013.01); *E21B 43/305* (2013.01)

(58) Field of Classification Search

CPC ..... E21B 43/281; E21B 43/28; E21B 43/14; E21B 43/305

See application file for complete search history.

(56) References Cited

U.S. PATENT DOCUMENTS

| | | | | |
|---|---|---|---|---|
| 2011/0127825 | A1* | 6/2011 | Hughes | E21B 43/292 299/4 |
| 2019/0368330 | A1* | 12/2019 | Hardage | E21B 43/283 |
| 2022/0195858 | A1* | 6/2022 | DeBusschere | E21B 47/07 |

* cited by examiner

*Primary Examiner* — George S Gray

(74) *Attorney, Agent, or Firm* — PatentFile, LLC; Bradley C. Fach; Steven R. Kick

(57) ABSTRACT

A modular solution mining method may include the steps of: providing an injection wellbore, the injection wellbore including a horizontal injection portion, in which the horizontal injection portion includes a toe end and heel end; providing a production wellbore, in which the production wellbore includes a horizontal production portion that is proximate to the toe end; injecting a solvent into the horizontal injection portion; generating a turbulent solvent flow proximate to the toe end to generate a mineral solution and an initial cavern proximate to the horizontal production portion; and motivating the mineral solution from the initial cavern, into the horizontal production portion, and to a surface location. Optionally, the method may include the step of repositioning the turbulent solvent flow to be closer to heel ends to generate mineral solution and subsequent caverns further from horizontal production wellbore.

17 Claims, 5 Drawing Sheets

MODULAR SOLUTION MINING SYSTEM AND METHODS

CROSS REFERENCE TO RELATED APPLICATIONS

This application claims priority to and the benefit of the filing date of U.S. Provisional Application No. 63/157,315, filed on Mar. 5, 2021, entitled "MODULAR SOLUTION MINING SYSTEM AND METHODS", which is hereby incorporated by reference in its entirety.

FIELD OF THE INVENTION

This patent specification relates to the field of mining soluble minerals from a subterranean deposit. More specifically, this patent specification relates to a system and methods for providing modular solution mining.

BACKGROUND

In the art of mining for minerals it is known that solution mining requires boring injection and production wells into the ground such that the wells have access to a subterranean mineral deposit. Typically, a solution is injected into the subterranean deposit to dissolve any soluble minerals. The dissolved mineral solution is then pumped out of the ground to the surface and the solution may subsequently be evaporated or otherwise processed in order for the desired mineral to be harvested. This differs from conventional mining, which involves mechanically boring underground shafts to access a subterranean mineral deposit.

Solution mining methods are preferable due to safety and the high capital barrier of conventional mining. It has been found, however, that many conventional solution and selective solution mining methods utilizing vertical rather than horizontal wellbores suffer from drawbacks such as the extended time required to dissolve salts or other minerals and create caverns for surface area primary mining and the relatively low flow rates of solution recovery. In these methods large surface area and high flow rates are required for mineral dissolution.

Therefore, a need exists for novel systems and methods of mining soluble minerals from a subterranean deposit which do not suffer from these drawbacks.

BRIEF SUMMARY OF THE INVENTION

A modular solution mining system and methods are provided which may be used for solution mining of subterranean soluble mineral deposits or mineral compounds with the aid of a suitable solvent. The system and methods of the present invention preferably involves controlled connections between generally horizontal wells with injection points that are relocated along the horizontal injection from toe to heel as caverns generated by the solvent dissolving the minerals of the mineral deposit are depleted of dissolvable minerals.

In some embodiments, a modular solution mining method may include the steps of: providing an injection wellbore, the injection wellbore including a horizontal injection portion, in which the horizontal injection portion includes a toe end and heel end; providing a production wellbore, in which the production wellbore includes a horizontal production portion that is proximate to the toe end; injecting a solvent into the horizontal injection portion; generating a turbulent solvent flow proximate to the toe end to generate a mineral solution and an initial cavern proximate to the horizontal production portion; and motivating the mineral solution from the initial cavern, into the horizontal production portion, and to a surface location. Optionally, the method may include: repositioning the turbulent solvent flow to be closer to heel ends to generate mineral solution and subsequent caverns further from horizontal production wellbore.

In further embodiments, a modular solution mining method may include the steps of: providing one or more generally horizontal injection portions passing above, under or through a mineral deposit; injecting a solvent fluid into the horizontal injection portions and allowing the injected solvent fluid to enter the deposit at the toes of the horizontal injection portions at a pressure and injection rate sufficient to create solvent turbulent flow through the deposit, allowing the injected solvent fluid to dissolve some of the soluble minerals from the deposit thereby forming a mineral solution; thus creating one or more initial caverns; providing at least one generally horizontal production portion passing above, under or through the deposit that is substantially perpendicular to the horizontal injection portions at a location such that the horizontal production portion intersects the cavern created by the injection wellbore thereby rendering the horizontal production wellbore in fluid communication with the horizontal injection wellbore; allowing the mineral solution to flow through the cavern(s) and into the horizontal production wellbore; and producing the mineral solution to surface from the horizontal production wellbore. Optionally, the method may include the steps of: providing for subsequent isolation of the initial injection point and creation of a secondary, tertiary and additional injection points toward the heel of the horizontal wellbore over time, thus expanding the producing cavern toward the heel of the horizontal injection wellbore. Preferably, the method may be used to mine a forty-acre or any other size module, with the procedure repeatable over the mineral deposit area.

In still further embodiments, the modular solution mining system and methods overcome the time delays between injection and initial production by placing the horizontal production portion at approximately right angles and in close proximity of two or more, such as three, horizontal injection portions.

In still further embodiments, the modular solution mining system and methods provides a rapid increase in production mineral flow rates by utilizing three or more horizontal injection portions in parallel to maximize the surface area of the caverns and control mineral solution flow into the production wellbore. The staged cavern creation and control of injection rates and pressures ensures that the caverns surrounding the horizontal injection portions enlarge and connect uniformly, producing a single elongated cavern and a balanced sweep of the resource from the mineral deposit.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 2:
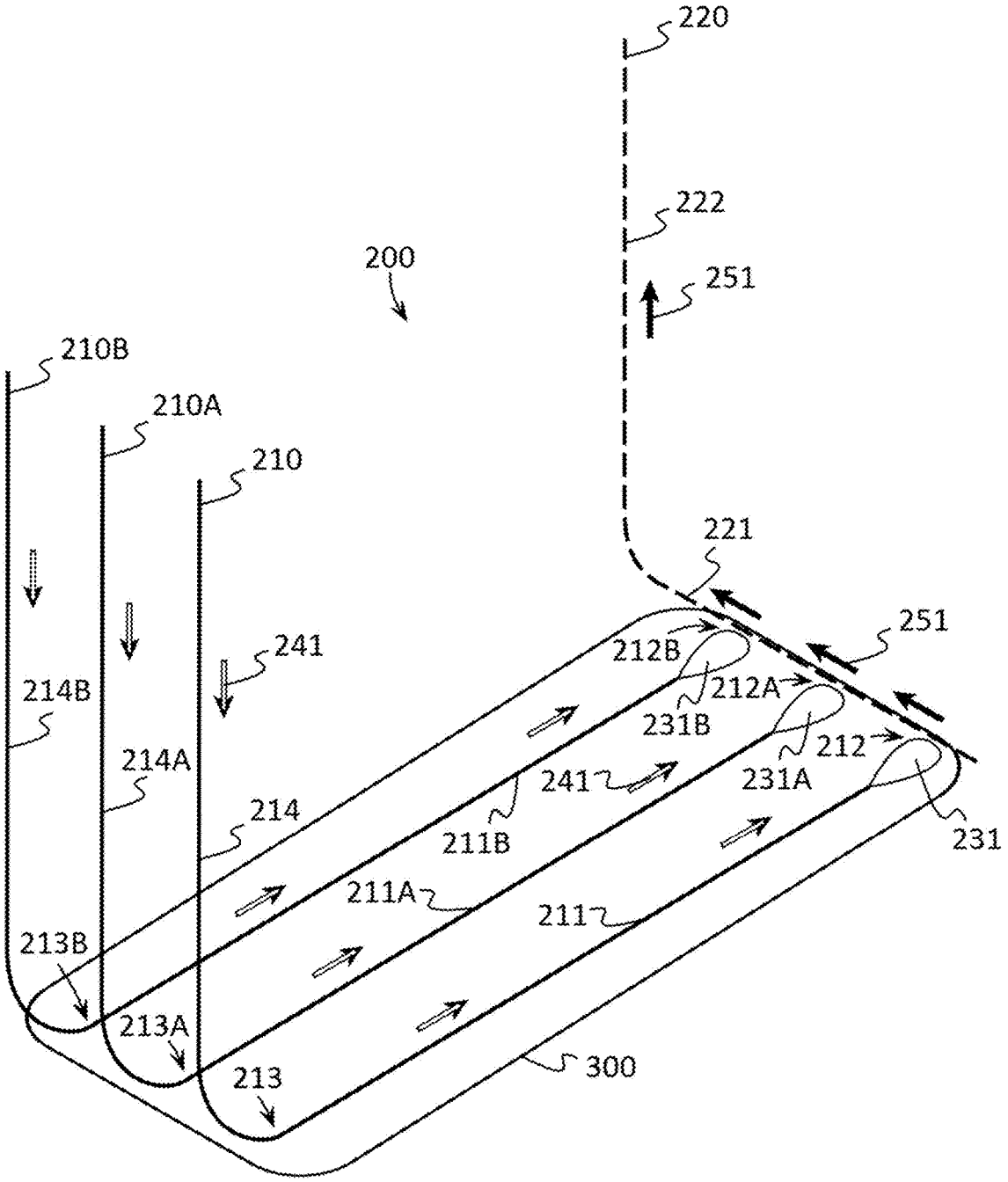
FIG. 2 illustrates a schematic diagram, perspective view of an example of a modular solution mining system having three horizontal injection wellbores according to various embodiments described herein.

For purposes of description herein, the terms "upper," "lower," "left," "right," "rear," "front," "side," "vertical," "horizontal," and derivatives thereof shall relate to the invention as oriented in FIG. 2. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the phrase "process brine" should be interpreted to include saline water such as, but not limited to, brackish water, solvent, and saturated sodium chloride solution as would be apparent to a person skilled in the art. Furthermore, the term "solvent" should be interpreted to include a fluid that is capable, due to its particular chemical composition, to dissolve the referred minerals in-situ, for instance sylvite. The system and methods described herein is able to also apply to other leachable or acid or cyanide soluble minerals, such as soluble copper minerals, gold, silver, etc., within a tabular mineral deposit of any spacial orientation.

As used in this application, the term "about" or "approximately" refers to a range of values within plus or minus 10% of the specified number. Additionally, as used in this application, the term "substantially" means that the actual value is within about 10% of the actual desired value, more preferably within about 5% of the actual desired value and even more preferably within about 1% of the actual desired value of any variable, element or limit set forth herein.

A new modular solution mining system and methods are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

Figure 1:
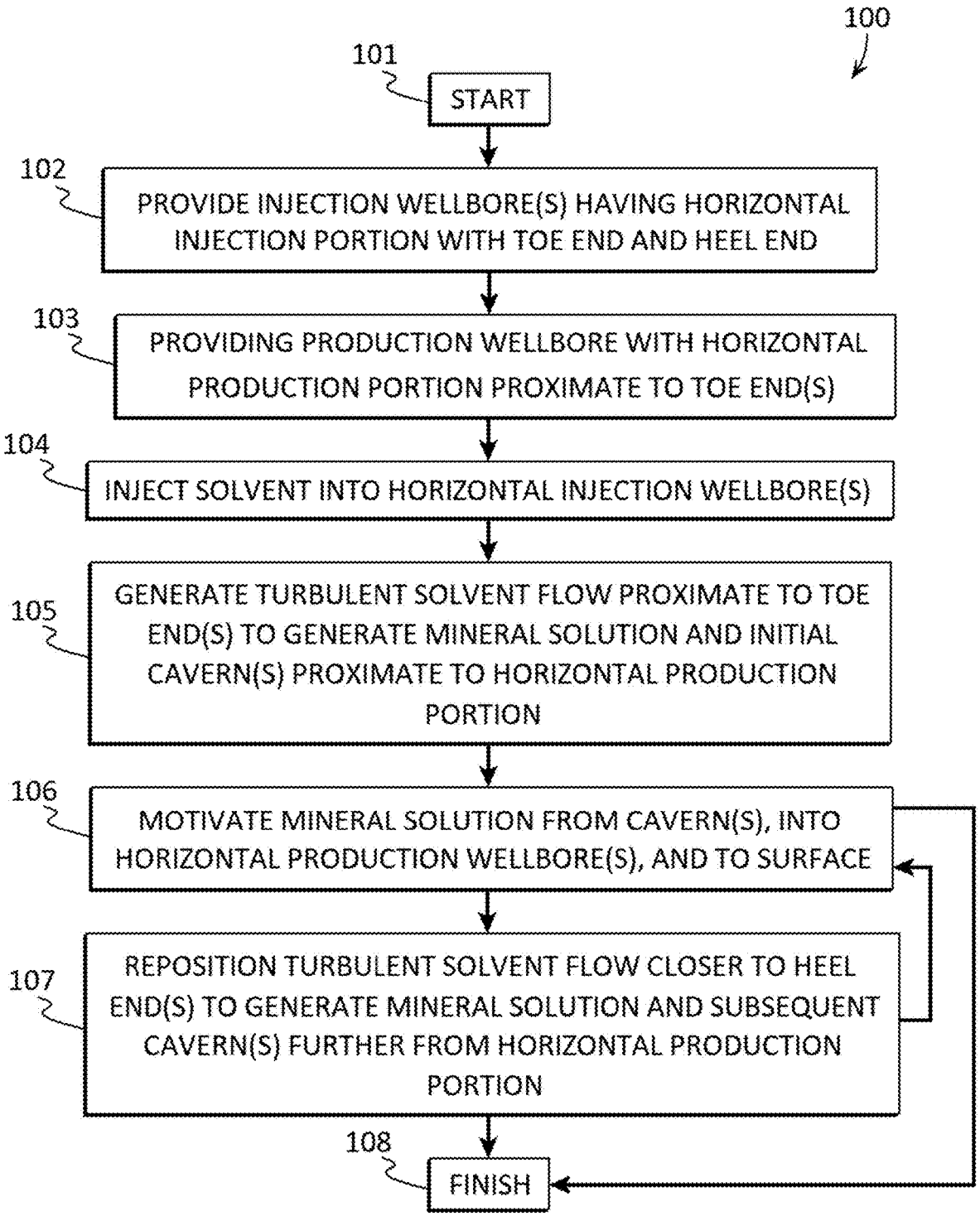
FIG. 1 depicts a block diagram of an example of a modular solution mining method according to various embodiments described herein.

The present invention will now be described by example and through referencing the appended figures representing preferred and alternative embodiments. FIG. 1 illustrates an example of a modular solution mining method ("the method") 100 and FIGS. 2-7 illustrate some example components of an example of a modular solution mining system ("the system") 200 according to various embodiments.

In preferred embodiments, the system 200 may comprise one or more injection wellbores 210, 210A, 210B, each having a horizontal injection portion 211, 211A, 211B, and optionally each having a vertical injection portion 214, 214A, 214B. It should be understood that the suffixes of "A", "B", "C", etc., designate different embodiments of an element, such as to distinguish a first element from a second element in description of the invention and in the figures. For example, the teachings of a first injection wellbore 210 read on the teachings of a second injection wellbore 210A, third injection wellbore 210B, etc., and vice versa. Each horizontal injection portion 211, 211A, 211B, may have a toe end 212, 212A, 212B, and a heel end 213, 213A, 213B. The system 200 may also comprise at least one production wellbore 220, and each production wellbore 220 may have a horizontal production portion 221 and optionally a vertical production portion 222. The system 200 may be configured to perform the steps of the method 100 as described below.

Figure 7:
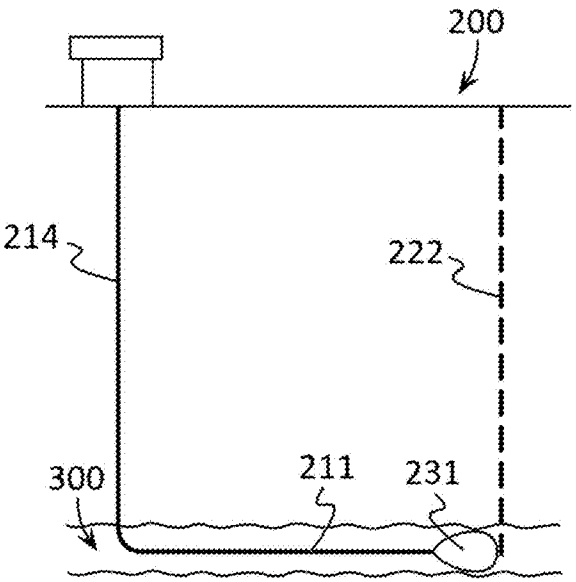
FIG. 7 depicts a schematic diagram, second side elevation view of the example modular solution mining system of FIG. 6 according to various embodiments described herein.

In some embodiments, the method 100 may start 101 and one or more injection wellbores 210, 210A, 210B, may be provided, each having a horizontal injection portion 211, 211A, 211B, and each horizontal injection portion 211, 211A, 211B, may have a toe end 212, 212A, 212B, and a heel end 213, 213A, 213B, in step 102. Generally, each horizontal injection portion 211, 211A, 211B, may be positioned so that the horizontal injection portions 211, 211A, 211B, between their respective toe ends 212, 212A, 212B, and heel ends 213, 213A, 213B, pass above, under, and/or through a desired mineral deposit 300 (FIG. 7). Preferably, step 102 may comprise drilling and casing horizontal injection portions 211, 211A, 211B, that are generally horizontal targeting the lowest strata of the targeted exploitable mineral deposit 300. In some embodiments, the horizontal injection portions 211, 211A, 211B, may be configured so that, between their respective toe ends 212, 212A, 212B, and heel ends 213, 213A, 213B, the horizontal injection portions 211, 211A, 211B, may remain approximately parallel to the slope or dip of the mineral deposit 300 (as shown in FIG. 7). In preferred embodiments, a horizontal injection portions 211, 211A, 211B, may be approximately parallel to the slope or dip of the mineral deposit 300 so as to be within plus or minus ten degrees of being parallel to the slope or dip of the mineral deposit 300. In further embodiments, a horizontal injection portions 211, 211A, 211B, may be oriented within 0 to 90 degrees of horizontal. Dip is the angle or slope of the mineral bed or deposit 300 from horizontal e.g., 0 to 90 degrees. Preferably, the horizontal injection portions 211, 211A, 211B, of the injection wells 210, 210A, 210B, should be horizontal across that slope or dip, along strike and remain within the mineral deposit 300. However, in some embodiments, the horizontal injection portions 211, 211A, 211B, may be down dip (parallel). If for example, in a steeply dipping mineral strata or deposit 300, the solution becomes heavier as it dissolves the minerals and it would be beneficial to collect the pregnant liquor from a lower elevation in the production well 220 that would be perpendicular to the injection wells 210, 210A, 210B.

In further embodiments, step 102 may comprise providing at least three, generally horizontal and generally parallel to each other, injection portions 211, 211A, 211B, passing, between their respective toe ends 212, 212A, 212B, and heel ends 213, 213A, 213B, above, under and/or through a desired mineral deposit 300. As a non-limiting example, the spacing between parallel horizontal injection portions 211, 211A, 211B, may be more or less than three hundred feet, and length of the horizontal injection portions 211, 211A, 211B, may be more or less than one thousand five hundred feet.

Figure 5:
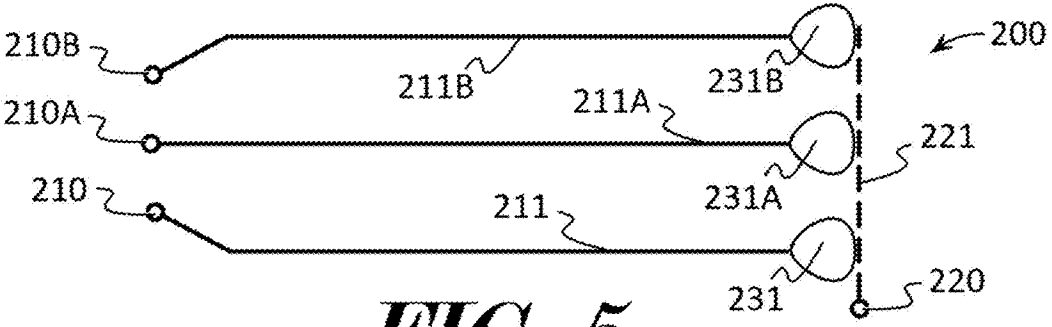
FIG. 5 illustrates a schematic diagram, top plan view of an example positioning of horizontal injection wellbores and a horizontal production wellbore according to various embodiments described herein.
Figure 6:
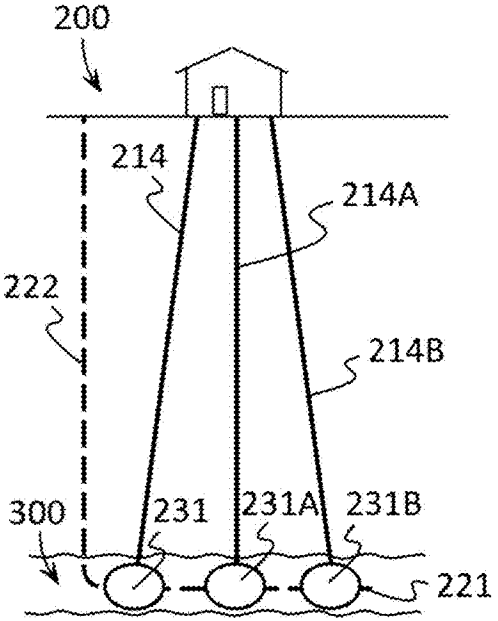
FIG. 6 shows a schematic diagram, first side elevation view of an example of a modular solution mining system having three horizontal injection wellbores according to various embodiments described herein.

In preferred embodiments, injection wellbores 210, 210A, 210B, each comprising a generally horizontal injection portion 211, 211A, 211B, that may extend between the toe 212, 212A, 212B, and heel 213, 213A, 213B, ends, may be directionally drilled to ensure the surface location of each of the injection wellbores 210, 210A, 210B, are as close to, but greater than 25 meters, from the surface location of the other injection wellbores 210, 210A, 210B, as illustrated in FIGS. 5 and 6. This ensures that the surface footprint is minimal and is achieved by curving, angling, etc., the vertical injection portions 214, 214A, 214B, of the injection wells 210, 210A, 210B, so as to move away from the surface location of each of the injection wellbores 210, 210A, 210B, while drilling the injection portions 214, 214A, 214B, and build sections of the parallel adjacent horizontal injection portions 211, 211A, 211B.

In step 103, one or more production wellbores 220 may be provided, in which each production wellbore 220 includes a horizontal production portion 211 that is proximate to the toe ends 212, 212A, 212B, of the one or more horizontal injection portions 211, 211A, 211B. Referring to the schematic diagram of an example embodiment of a system 200 shown in FIGS. 5-7, three parallel horizontal injection portions 211, 211A, 211B, are shown to be terminated in proximity to a horizontal production portion 221. In preferred embodiments, a horizontal production portion 221 of a production wellbore 220 may be drilled preferably parallel to the slope or dip of the mineral deposit 300 and to close proximity, by being within zero to fifty feet, with the toe ends 212, 212A, 212B, of the injection wellbores 210, 210A, 210B, allowing rapid injection fluid communication between the horizontal injection portions 211, 211A, 211B, and horizontal production portion 221 upon injection of a solvent into the horizontal injection portions 211, 211A, 211B. In further preferred embodiments, a horizontal production portion 221 of a production wellbore 220 may be drilled in proximity, by being within zero to one hundred feet, with the toe ends 212, 212A, 212B, of the injection wellbores 210, 210A, 210B, allowing injection fluid communication between the horizontal injection portions 211, 211A, 211B, and horizontal production portion 221 upon injection of a solvent into the horizontal injection portions 211, 211A, 211B.

In further preferred embodiments, a horizontal production portion 221 may be generally perpendicular, within plus or minus 5 degrees of perpendicular (as shown in FIGS. 1, 5, and 7) with one or more, and more preferably all, of the horizontal injection portions 211, 211A, 211B. In still further preferred embodiments, a horizontal production portion 221 may be substantially perpendicular, within plus or minus 2 degrees of perpendicular, with one or more, and more preferably all, of the horizontal injection portions 211, 211A, 211B.

In further preferred embodiments, step 102 and 103 may comprise providing at least one generally horizontal production portion 221, passing above, under or through the mineral deposit 300, that is substantially perpendicular with one or more of the horizontal injection portions(s) 211, 211A, 211B, at a location such that the production portion 221 is in proximity (within with zero to one hundred feet and more preferably within with zero to 50 feet) to the toes 212, 212A, 212B, of the horizontal injection portions 211, 211A, 211B, rendering the horizontal production wellbore(s) 221 in fluid communication with the one or more, such as three, horizontal injection portions 211, 211A, 211B. It should be understood that the term "horizontal" as used in horizontal injection portions 211, 211A, 211B, and horizontal production portions 221 are not limited to being perfectly horizontal with respect to the action of gravity. The term "horizontal" preferably indicates a wellbore 211, 221, drilled at any angle other than vertical. Horizontal drilling is simply a drilling process which allows drilling at different angles. It is a generic term that indicates drilling a hole at an angle other than vertical. In this manner, horizontal injection portions 211, 211A, 211B, and horizontal production wellbores 221 may be configured to be any angle other than vertical based upon orientation of the mineralized ore body 300. Preferably, the horizontal injection portions 211, 211A, 211B, may be generally perpendicular with a horizontal production portion 221 that ties the ends of those injection portions 211, 211A, 211B, together as the caverns 231, 231A, 231B, 232, 233, are created and mined. Furthermore, one or more injection portions 211, 211A, 211B, may not be perfectly horizontal and their orientation may depend upon the best fit to the orientation of the mineral strata or body 300. For example, if the mineral body 300 has a degree of dip to it, the injection portions 211, 211A, 211B, may be installed perpendicular to that body's 300 dip in the horizontal plane or down dip depending upon the characteristics of the mineral body 300. This system 200 will work in any orientation or dip of a mineral body 300, whether planar, irregular, spherical, reid shaped, etc.

Figure 3:
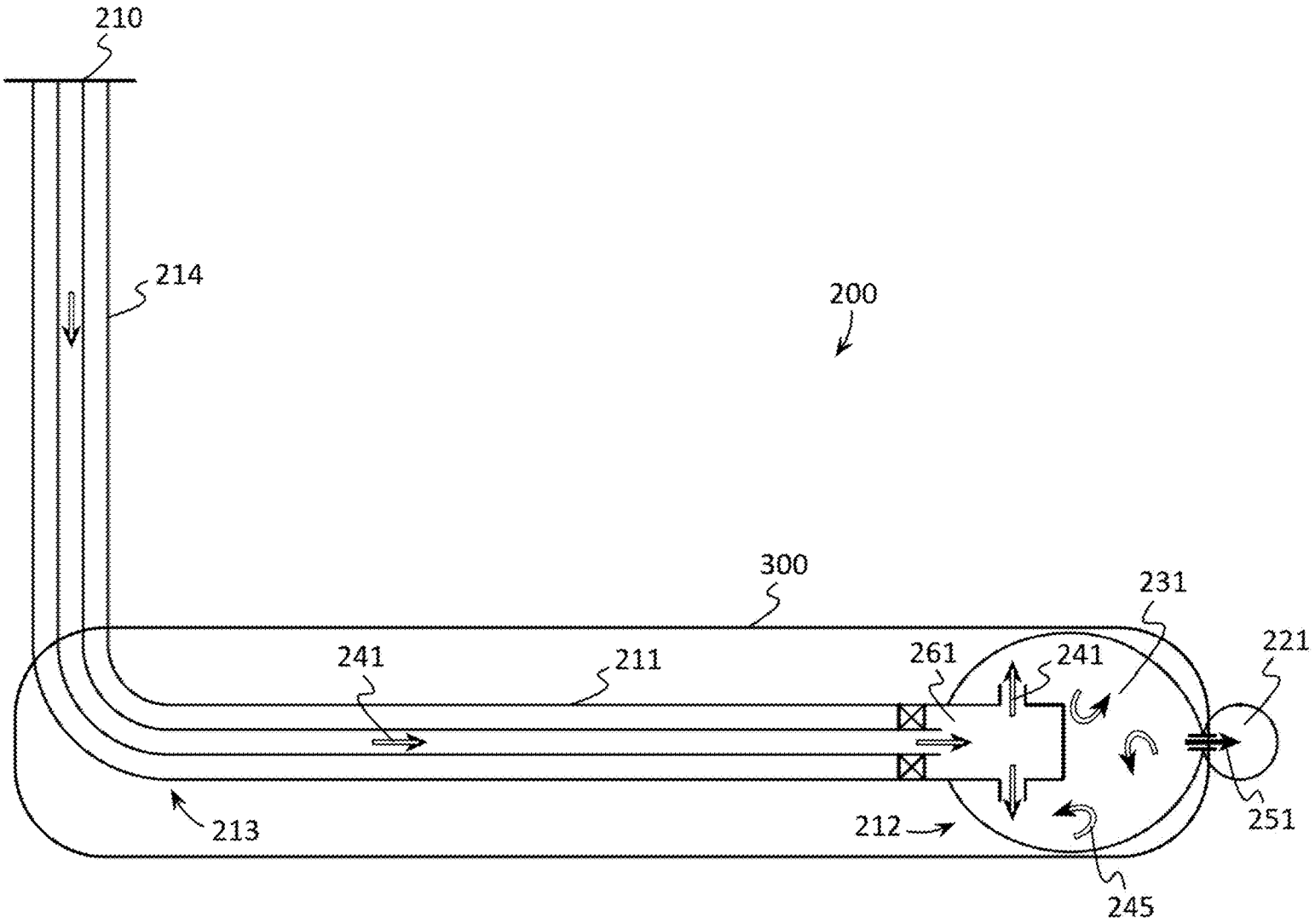
FIG. 3 shows a schematic diagram, elevation view of an example of a horizontal injection wellbore and cavern in relation to a horizontal production wellbore according to various embodiments described herein.

In step 104, solvent may be injected into the horizontal injection portions 211, 211A, 211B. In some embodiments of step 104, solvent may be injected into the horizontal injection portions 211, 211A, 211B, (direction of solvent flow shown with arrows 241 in FIGS. 2-4) so that the casing is successively perforated along the length of the horizontal injection portions 211, 211A, 211B, from the toe end 212, 212A, 212B, to the heel end 213, 213A, 213B, of the horizontal casing and solvent is injected into the horizontal injection portions 211, 211A, 211B, through tubing and an isolation packer 261, as shown in FIG. 3. In preferred embodiments, solvent is injected through tubing and an isolation packer 261 into the horizontal injection portions 211, 211A, 211B, so that the casing is perforated from the toe end 212, 212A, 212B, of the horizontal injection portions 211, 211A, 211B, to the isolation packer 261 position and as the caverns 231, 231A, 231B, 232, 233, are developed the isolation packer 261 is subsequently moved towards the heel ends 213, 213A, 213B, of the horizontal injection portions 211, 211A, 211B, in stages and the horizontal injection well casing 210, 210A, 210B, is perforated across those stages until the isolation packer 261 is moved to the heel ends 213, 213A, 213B, of the horizontal injection well 210, 210A, 210B, and the horizontal injection portions 211, 211A, 211B, of the injection well 210, 210A, 210B, is fully perforated.

In preferred embodiments, the solvent may comprise process brine that may be produced from one or more process brine source well(s), that preferably may be located at a near distance to the one or more injection wells 210, 210A, 210B. Process brine wells near a projected mining field may be initially drilled to the stratum that can produce a sufficient amount of process brine having a suitable geothermic heat content equal to or higher than the geothermic heat contained in the mineral stratum or strata to be mined. Preferably, the injected solvent fluid may be heated to a temperature higher than the temperature of the mineral deposit 300. In some embodiments, the solvent fluid may be heated to between 10 and 30 degrees Celsius higher than the temperature of the mineral deposit 300. In further embodiments, the solvent fluid may be heated to between 10 and 100 degrees Celsius higher than the temperature of the mineral deposit 300. The solvent fluid may be pre-heated by artificial/mechanical and/or natural means. For example, process brine wells may be provided and then perforated, and a submersible pump is employed if needed to produce process brine water which may be used as a solvent. If the stratum appears tighter than expected, a short horizontal leg (100-200 meters) can be drilled to allow for more process brine to be produced.

In instances when drilling to a sufficient depth level to obtain process brine of a desired temperature is not practical, a process brine of a lower heat content may be used, and its temperature subsequently raised either by artificial/mechanical means or by heat exchange means with the geothermic environment prevailing in the mineral stratum during the process of enriching brine to maturity. In preferred embodiments, process brine that is approximately 20 degrees Celsius (68° F.) warmer than the formation temperature may be employed as the solvent of the present invention, and higher production rates may be obtained as heated brine allows sodium chloride to dissolve and free the embedded potassium chloride crystals.

In some embodiments, the mining of soluble minerals or mineral compounds may be achieved with the aid of a suitable solvent obtained from selected subterranean deposits. Such minerals or mineral compounds that may be mined by the present invention include, but are not limited to; halite, potassium chloride (potash) based minerals, such as sylvinite/sylvite, and carnallite, copper, gold, silver from an ore body, salts of lithium, salts of uranium, and any other mineral or material which may be soluble in a solvent which may be used in solution mining. In some embodiments, the solvent may be derived from subterranean sources of naturally occurring fresh water, brackish water, and saline water (often collectively called brines when not fresh), and some sources may be heated naturally, as in a hot spring. Minerals that can be mined or leached from the subterranean deposits with these water-based solvents are usually water-soluble salts. However, copper, silver and other metals/minerals may be leached with acid-based solvents or, cyanide, iodide, bromide or halide-based leaches, all manmade and sourced from industrial chemicals. Regarding the minerals that may be leached by these solvents; they may or may not be salts, e.g., Uranium or silver may be in the form of a salt or sulfide or oxide and in the case of copper, silver and gold, may be native metal. In further embodiments, the solvent may be derived mainly from a subterranean source located above or below a stratum of the embedded soluble minerals. In further embodiments, the solvent may be recovered brine.

In some exemplary embodiments of the present invention, non-selective solution mining may be carried out by the continuous injection of solvent into a mineral deposit 300 comprising potash stratum. Non-selective solution mining occurs when the injected solvent dissolves a wide array of different minerals within the stratum due to the concentration and make-up of the injected solvent. The amount of injected solvent, such as brine, that may be employed, sometimes referred to as the process brine, may depend on the ore ratio of the mineable deposit 300 and the temperature conditions present in the subsurface environment.

In step 105, turbulent solvent flow 245 proximate to the toe end(s) 212, 212A, 212B, may be generated in the horizontal injection portions 211, 211A, 211B, to generate mineral solution (direction of mineral solution flow shown with arrows 251) and an initial cavern 231, 231A, 231B, proximate to the horizontal production portion 221. Preferably, turbulent solvent flow 245 may be used to accelerate the dissolution process and keep insolubles from settling out which may block the solvent from accessing and dissolving the targeted minerals. In some embodiments, turbulent solvent flow 245 may be generated by injecting process brine solvent at pressure to create turbulent flow in the mining/fracture plane which can facilitate mineral dissolution, and/or injecting under saturated brine solvent to dissolve minerals in the mineral deposit 300, such as sodium chloride and free potassium chloride trapped between halite crystals. In further embodiments, step 105 may include progressively isolating and perforating for injection a section of the horizontal injection portions 211, 211A, 211B, at the toe ends 212, 212A, 212B, of the horizontal injection portions 211, 211A, 211B, reducing the time required to establish fluid communication between the injection 210, 210A, 210B, and production wellbores 220 and creation of the initial dissolved cavern 231, 231A, 231B. In further embodiments, the solvent may be injected into the horizontal injection portions 211, 211A, 211B, and the injected solvent may be allowed to enter the perforations from the horizontal injection portion 211, 211A, 211B, at a pressure sufficient to create turbulent flow 245 of the injected solvent fluid. The injected solvent fluid may be allowed to dissolve some of the soluble minerals from the deposit 300 thereby forming a mineral solution.

Solvent fluid may be injected into the horizontal injection portions 211, 211A, 211B, and may be circulated under hydraulic pressure sufficient to establish communication between the horizontal injection wells 210, 210A, 210B, and the horizontal production well(s) 220 and subsequently establish turbulent flow 245 in order to speed the dissolution of the salt and minerals. In some embodiments, solvent comprising process brine may be injected into the horizontal injection portions 211, 211A, 211B, under pressure, which then begins to dissolve the salts of the mineral deposit 300, establishing communication with the horizontal production portion 221, and creating the initial cavern 231, 231A, 231B, at the toe ends 212, 212A, 212B, of each horizontal injection portion 211, 211A, 211B. It is preferable to commence injection no more than 10 feet above to 20 feet below the desired mineral deposit by positioning the horizontal injection portions 211, 211A, 211B, no more than 10 feet above and 20 feet below mineral deposit 300 to take advantage of the eventual tendency of the process brine, by virtue of its lesser density, to rise to the top of caverns 231, 231A, 231B, 232, 233, and dissolve the preferred minerals from the roof of the caverns 231, 231A, 231B, 232, 233, in the mineral strata of the mineral deposit 300.

In some embodiments, an injection pump may be employed for injecting the solvent and creating the pressure needed in order to generate the turbulent solvent flow 245 that may establish communication with the horizontal production portion 221. Preferably, turbulent solvent flow 245 may be generated by having the solvent circulated at the toe ends 212, 212A, 212B, of each horizontal injection portion 211, 211A, 211B, thus creating an initial cavern 231, 231A, 231B, in each horizontal injection portion 211, 211A, 211B, as would be clear to those skilled in the art. In further embodiments, the process brine injection pressure and rates may be increased and decreased to balance cavern building in parallel horizontal injection wells.

In some embodiments, dyed substances may be blended into the injection solvent along with micro-seismic mapping techniques known to those skilled in the art in order to assist in tracking the propagation of the injected solvent along the horizontal injection portions 211, 211A, 211B. This may assist in the regulation of injection rates and pressures and ensure that the horizontal production wellbore(s) 221 are connected to the caverns 231, 231A, 231B, 232, 233, created by the turbulent solvent flow 245 in the horizontal injection portions 211, 211A, 211B of the horizontal injection wells 210, 210A, 210B.

In step 106, mineral solution may be motivated from the cavern(s) 231, 231A, 231B, 232, 233, into horizontal production wellbore(s) 221, and to the surface. In preferred embodiments, mineral solution may be motivated by the injection of solvent into the horizontal production wellbore (s) 221. In further embodiments, step 106 may include recirculating the solvent, whereby once the process brine and mineral solution coming from the production wellbore 220 has been refined and the minerals have been removed, the resulting refinery brine can be mixed with other fluids before being injected downhole. Preferably, the solvent path may extend from the injection points parallel to the horizontal injection portion 211, 211A, 211B, into and through the cavern(s) 231, 231A, 231B, 232, 233, and into the perpendicular horizontal production portion 221. Recovered minerals, from the produced mineral solution, may be mainly sylvite and halite. In some exemplary embodiments, the produced mineral solution is substantially saturated with the subterranean minerals. In some embodiments, after step 106, the method 100 may finish 108. In further embodiments, after step 106, the method may continue to step 107.

Figure 4:
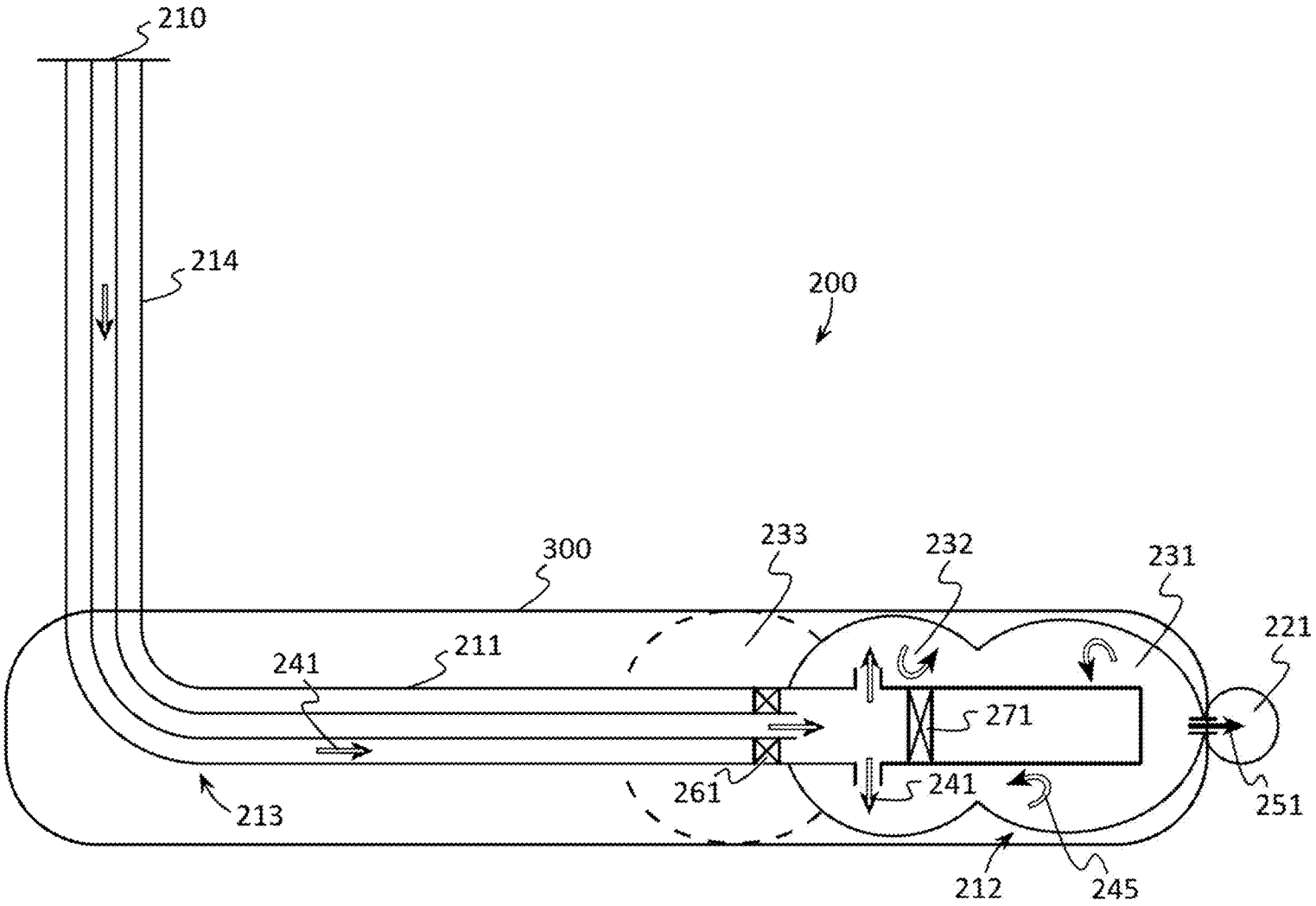
FIG. 4 depicts a schematic diagram, elevation view of an example of a horizontal injection wellbore with an initial cavern and subsequent cavern development in relation to a horizontal production wellbore according to various embodiments described herein.

In step 107, turbulent solvent flow 245 may be repositioned closer to heel end(s) to generate mineral solution and one or more subsequent cavern(s) 232, 233, etc., further from horizontal production portion 221. In preferred embodiments, turbulent solvent flow 245 may be repositioned closer to heel end(s) to generate mineral solution and a subsequent enlarged cavern(s) 232, 233, etc., that spans the horizontal injection portion(s) 211, 211A, 211B, from the toe end(s) 212, 212A, 212B, to the heel end(s) 213, 213A, 213B. After production from the initial cavern 231, 231A, 231B, is well established and potash is being recovered by dissolving the mineral deposit 300, the initial perforations are sealed off by means of placement of a bridge plug 271 in front of the initial perforations, and subsequent perforations are introduced further toward the heel 213, 213A, 213B, of the well casing of the one or more horizontal injection portions 211, 211A, 211B, as shown in FIG. 4. This second injection location may again be isolated with a production or isolation packer 261. The turbulent solvent flow 245 may then continue to dissolve the mineral deposit 300 thereby forming a subsequent cavern 232 which may expand to join the initial cavern 231 as shown in FIG. 4. As the process brine solvent/mineral solution flows through the second or subsequent cavern 232 and into the initial cavern 231A and the production horizontal wellbore 221, the subsequent cavern 232 is greatly enlarged allowing more minerals to be recovered.

In preferred embodiments, steps 106 and 107 may be repeated until an extended cavern (formed of an initial cavern 231, 231A, 231B, and any number of subsequent caverns 232, 233, which may be joined together by the solvent circulation/turbulence) extends from approximately the toe end 212, 212A, 212B, to the heel end 213, 213A, 213B, of each horizontal injection portion 211, 211A, 211B, as shown in FIG. 4. Preferably, steps 106 and 107 may be repeated to subsequently isolate the initial injection point in each horizontal injection portion 211, 211A, 211B, and create a second, third, fourth, fifth, etc., injection point(s) progressively toward the heel 213, 213A, 213B, of the horizontal injection well 211, resulting in the creation of a second 232, third 232, fourth, fifth, etc., subsequent caverns, and the mineral solution produced from the second injection point thus creating the second 232, third 233, fourth, fifth, etc., subsequent caverns and the mineral solution may flow, under pressure, through the caverns 231, 231A, 231B, 232, 233, into the production wellbore 220 via the horizontal production portion 221.

Preferably, perforating and staging injection points from the toe 212, 212A, 212B, to the heel 213, 213A, 213B, of the horizontal injection portions 211, 211A, 211B, provides timely connection between the injection 210, 210A, 210B, and production 220 wells and a progressive and balanced creation of the caverns 231, 231A, 231B, 232, 233, etc., surrounding the horizontal injection wells 211. These exemplary methods may be repeated to expand the initial cavern 231, 231A, 231B, of each horizontal injection portion 211, 211A, 211B, toward the heel end 213, 213A, 213B, of the one or more horizontal injection portions 211, 211A, 211B, via a series of one or more subsequent caverns 232, 233, until the mineral deposit 300 is substantially exhausted as no more mineral material can be economically recovered. After step 107, the method 100 may finish 108.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A modular solution mining method for use with a mineral deposit, the method comprising the steps of:

providing an injection wellbore, the injection wellbore including a horizontal injection portion, wherein the horizontal injection portion comprises a toe end and a heel end;

providing a production wellbore, wherein the production wellbore includes a horizontal production portion that is proximate to the toe end;

injecting a solvent into the horizontal injection portion;

generating a first turbulent solvent flow proximate to the toe end to generate a mineral solution and an initial first cavern proximate to the horizontal production portion;

motivating the mineral solution from the initial first cavern, into the horizontal production portion, and to a surface location;

placing a bridge plug into the horizontal injection portion between the toe end and the heel end; and generating a second turbulent solvent flow, the second turbulent solvent flow being generated closer to the heel end than the first turbulent solvent flow and the second turbulent solvent flow generating a subsequent second cavern located in between the heel end and first cavern.

2. The method of claim 1, further including the step of generating a third turbulent solvent flow, the third turbulent solvent flow generated closer to the heel end and generating a subsequent third cavern that is proximate to the subsequent second cavern and the third cavern located in between the subsequent second cavern and the heel end.

3. The method of claim 1, wherein the horizontal injection portion is within plus or minus ten degrees of being parallel to the slope or dip of the mineral deposit.

4. The method of claim 1, wherein the horizontal production portion is drilled within zero to one hundred feet of the toe end of the horizontal injection portion.

5. The method of claim 1, wherein the horizontal production portion is within plus or minus five degrees of being perpendicular with the horizontal injection portion.

6. The method of claim 1, wherein solvent is injected through tubing and an isolation packer into the horizontal injection portion so that a casing is perforated along the length of the horizontal injection portion.

7. The method of claim 1, wherein the solvent comprises process brine.

8. The method of claim 7, wherein the horizontal injection portion is positioned within ten feet above and twenty feet below the mineral deposit.

9. The method of claim 1, wherein the solvent is heated to a temperature higher than a temperature of the mineral deposit.

10. The method of claim 1, wherein the solvent is heated to between 10 and 30 degrees Celsius higher than a temperature of the mineral deposit.

11. A modular solution mining method for use with a mineral deposit, the method comprising the steps of:

providing an injection wellbore, the injection wellbore including a horizontal injection portion, wherein the horizontal injection portion comprises a toe end and a heel end;

providing a production wellbore, wherein the production wellbore includes a horizontal production portion that is proximate to the toe end of the injection wellbore;

injecting a solvent into the horizontal injection portion, wherein the solvent is heated to a temperature higher than a temperature of the mineral deposit;

generating a turbulent solvent flow proximate to the toe end to generate a mineral solution and an initial cavern proximate to the horizontal production portion;

motivating the mineral solution from the initial cavern, into the horizontal production portion, and to a surface location; and repositioning the turbulent solvent flow to be closer to the heel end to generate the mineral solution and a subsequent enlarged cavern that spans the horizontal injection well from the horizontal production well portion to the heel of the horizontal injection well; and wherein the horizontal production portion is within plus or minus five degrees of being perpendicular with the horizontal injection portion.

12. The method of claim 11, wherein the horizontal injection portion is within plus or minus ten degrees of being parallel to the slope or dip of the mineral deposit.

13. The method of claim 11, wherein the horizontal production portion is drilled within zero to one hundred feet of the toe end of the horizontal injection portion.

14. The method of claim 11, wherein solvent is injected through tubing and an isolation packer into the horizontal injection portion so that a casing is perforated along the length of the horizontal injection portion.

15. The method of claim 11, wherein the solvent comprises process brine.

16. The method of claim 15, wherein the horizontal injection portion is positioned within ten feet above and twenty feet below the mineral deposit.

17. The method of claim 11, wherein the solvent is heated to between 10 and 30 degrees Celsius higher than the temperature of the mineral deposit.

* * * * *